US009022516B2

(12) United States Patent
Mizutani et al.

(10) Patent No.: US 9,022,516 B2
(45) Date of Patent: May 5, 2015

(54) FLUID EJECTING APPARATUS

(71) Applicant: Seiko Epson Corporation, Tokyo (JP)

(72) Inventors: Seigo Mizutani, Azumino (JP); Shigeki Kato, Suwa (JP); Akihiro Toya, Matsumoto (JP); Toshiki Ogasawara, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/016,647

(22) Filed: Sep. 3, 2013

(65) Prior Publication Data

US 2014/0078201 A1 Mar. 20, 2014

(30) Foreign Application Priority Data

Aug. 29, 2012 (JP) ..... 2012-188407

(51) Int. Cl.

| | |
|---|---|
| ***B41J 29/393*** | (2006.01) |
| ***B41J 2/125*** | (2006.01) |
| ***B41J 11/00*** | (2006.01) |
| ***B41J 3/28*** | (2006.01) |

(52) U.S. Cl.

CPC ..... *B41J 2/125* (2013.01); *B41J 11/0095* (2013.01); *B41J 3/28* (2013.01); *B41J 11/0005* (2013.01); *B41J 11/002* (2013.01)

(58) Field of Classification Search

USPC ..... 347/2, 4, 14, 19; 101/35, 37, 41

See application file for complete search history.

(56) References Cited

U.S. PATENT DOCUMENTS

| | | | | |
|---|---|---|---|---|
| 3,490,674 | A * | 1/1970 | Ott et al. | 226/19 |
| 3,600,591 | A * | 8/1971 | Thier et al. | 356/20 |
| 5,541,626 | A * | 7/1996 | Hiramatsu et al. | 347/8 |
| 6,827,414 | B2 | 12/2004 | Iwatsuki et al. | |
| 2004/0041855 | A1 * | 3/2004 | Fujikawa et al. | 347/7 |
| 2009/0303276 | A1 | 12/2009 | Van de Wynckel et al. | |
| 2013/0265362 | A1 * | 10/2013 | Toya | 347/19 |
| 2014/0054845 | A1 * | 2/2014 | Morikawa et al. | 271/18 |

FOREIGN PATENT DOCUMENTS

| | | |
|---|---|---|
| JP | 2003-311938 | 11/2003 |
| JP | 2006-088612 | 4/2006 |

OTHER PUBLICATIONS

European Search Report for Application No. 13182836.0 dated Oct. 9, 2014.

* cited by examiner

*Primary Examiner* — Stephen Meier
*Assistant Examiner* — Sharon A Polk
(74) *Attorney, Agent, or Firm* — Workman Nydegger

(57) ABSTRACT

A fluid ejecting apparatus includes a pair of guide rails that movably supports a carriage and an abnormal portion detecting sensor that has a light emitting portion and a light receiving portion for receiving a light beam emitted from the light emitting portion, in which the light emitting portion and the light receiving portion are mounted on the carriage via a sensor mounting member.

3 Claims, 12 Drawing Sheets

FLUID EJECTING APPARATUS

TECHNICAL FIELD

The present invention relates to a fluid ejecting apparatus.

BACKGROUND ART

As an example of a fluid ejecting apparatus, an ink jet type printer has been known. This printer prints an image on a recording medium, such as a paper sheet, by causing a moving head to eject a fluid, such as ink, thereto. Furthermore, depending on the type of printer, when the printer performs a printing operation, foreign matter that adheres to various portions in the printer, such as a platen, is detected by an optical sensor or the like. Thereby, the foreign matter is prevented from interfering with the head before it happens (PTL 1).

CITATION LIST

Patent Literature

[PTL 1] JP-A-2006-88612

SUMMARY OF INVENTION

Technical Problem

In such a printer, a label paper sheet (also called a seal paper sheet) may be used as the recording medium mentioned above. A label paper sheet has a recording paper sheet (recording material) in which the opposite side of a recording target surface for an image is an adhesive layer and a separator (peeling material) that is provided to cover the adhesive layer. Usually, the label paper sheet is provided to a user, in the shape of a rolled paper sheet that is wound into a roll. The label paper sheet is mounted on an unwinding portion of a user's printer, and an image is printed (recorded) on the recording paper sheet that is unwound and transported.

When the label paper sheet is unwound, a peeling portion can be caused by partial peeling-off of the recording paper sheet from the separator. This peeling portion swells out because of a gap that is formed, due to the partial peeling-off described above, between the separator and the recording paper sheet. Thus, the peeling portion has an excessive thickness, compared to the original thickness of the label paper sheet. Therefore, there is a possibility that, during printing, the peeling portion may interfere with a head and damage the head.

Thus, this printer is provided with an abnormal portion detecting sensor that detects, as an abnormal portion on a rolled paper sheet, not only the foreign matter adhering to the rolled paper sheet but also the peeling portion. As an example of the abnormal portion detecting sensor, a sensor having a configuration in which a light emitting portion and a light receiving portion are provided can be exemplified. In this case, the light emitting portion is disposed on one end side in a paper width direction of a rolled paper sheet. Also, the light receiving portion is disposed on the other end side in the paper width direction such that the light beam emitted from the light emitting portion is received on the other end. Furthermore, if an abnormal portion is a peeling portion, this sensor detects the generation of the peeling portion in the following manner. When the peeling portion moves relatively so as to pass through the abnormal portion detecting sensor, the light beam emitted from the light emitting portion is blocked by the peeling portion, and therefore the light receiving state of the light receiving portion is changed. Therefore, the generation of the peeling portion is detected based on the change in the light receiving state.

A certain type of a print is configured to have a carriage and a pair of carriage guide rails. The carriage is adopted as a mechanism that causes a head to move to a predetermined position, relative to a recording medium on which fluid is ejected by the head. The carriage is supported by a carriage base and holds a head. The pair of carriage guide rails are disposed on both sides of the carriage so as to interpose the recording medium therebetween. The pair of carriage guide rails regulates a movement direction of the carriage base and movably supports the carriage base. Regarding the printer having such a configuration, it is difficult to maintain the processing accuracy of the carriage guide rail as an apparatus increases in size. In addition, the shape thereof is likely to be changed by bending, distortion or the like. Particularly, when a weight of the head and the carriage (including the carriage base) that supports the head increases owing to improvement in a drawing function, a large load is applied to the carriage guide rail. Thus, bending or distortion is likely to occur. Furthermore, when the carriage guide rail is bent or distorted, the state of the carriage base that is disposed in the vicinity of the area just above the carriage guide rail is changed due to the head (carriage) positioned on the carriage guide rail.

Thus, if the light emitting portion and the light receiving portion are fixed in the vicinity of the area just above the carriage guide rail, the positions of the light emitting portion and the light receiving portion are more likely to be displaced owing to the influence of the carriage guide rail. Therefore, the light beam emitted from the light emitting portion is not correctly received by the light receiving portion. As a result, there is a possibility that the abnormal portion on a recording medium may not be reliably detected.

Solution to Problem

The invention has been made to solve at least a part of the problem described above and can be realized as the following form or application example.

Application Example 1

A fluid ejecting apparatus according to an application example includes a transport portion that transports a recording medium, a support portion that supports the recording medium, a head that ejects a fluid onto the recording medium supported by the support portion, a carriage that holds the head and can move in a transport direction of the recording medium, a pair of carriage guide rails that supports the carriage such that the carriage can move in the transport direction of the recording medium, and an abnormal portion detecting sensor that has a light emitting portion which is disposed on one end side in a width direction of the recording medium, which is perpendicular to the transport direction of the recording medium, and a light receiving portion which is disposed on the other end side in the width direction such that a light beam emitted from the light emitting portion is received on the other end side, and detects an abnormal portion on the recording medium, in which the light emitting portion and the light receiving portion are mounted on the carriage via a sensor mounting member, and the sensor mounting member is fixed to the carriage at a position close to the center of the carriage in the width direction, within an area specified by the pair of carriage guide rails.

According to the fluid ejecting apparatus, the sensor mounting member on which the light emitting portion and the light receiving portion are mounted is fixed to the carriage at a fixing position, which is close to the center of the area between the pair of carriage guide rails that are respectively disposed on both sides of the carriage so as to interpose the support portion therebetween. Therefore, even when the carriage guide rail is bent, it is difficult for the light emitting portion and the light receiving portion to be influenced. Thus, it is possible to maintain the positional relationship in which the light beam emitted from the light emitting portion is correctly received by the light receiving portion.

As a result, it is possible to improve the detection accuracy of the abnormal portion detecting sensor when detecting an abnormal portion, such as peeling of a recording medium that is supported on the support portion.

Application Example 2

In the fluid ejecting apparatus according to the application example described above, it is preferable that the light emitting portion and the light receiving portion be aligned and mounted on the single sensor mounting member, and the sensor mounting member be fixed to the carriage at an intermediate position of an area between the light receiving portion and the light emitting portion.

According to this configuration, the positional relationship between the light emitting portion and the light receiving portion is set such that the light emitting portion and the light receiving portion are subjected to less influence caused by the bending of the carriage guide rail. Thus, it is possible to detect an abnormal portion on a recording medium with high detection accuracy.

Application Example 3

In the fluid ejecting apparatus according to the application example described above, a pair of the abnormal portion detecting sensors may be provided so as to be aligned in the transport direction of the recording medium, and the pair of abnormal portion detecting sensors may be arranged so that the light emitting directions thereof are opposite to each other.

According to the fluid ejecting apparatus, it is possible to effectively detect an abnormal portion even when the abnormal portion is partially generated at an arbitrary position in the paper width direction. In some cases, the abnormal portion is formed on a recording medium at a position close to one end or the other end in the paper width direction. However, when the pair of abnormal portion detecting sensors are arranged so that the light emitting directions thereof are opposite to each other, as described above, the pair of abnormal portion detecting sensors are symmetrically the same, in terms of detecting abilities, with respect to the center portion in the paper width direction. Thus, even when the abnormal portion is located on a paper sheet at a position close to one end or the other end on a paper sheet in the paper width direction, it is possible to detect the abnormal portion with high detection accuracy.

BRIEF DESCRIPTION OF DRAWINGS

FIG. 3A shows a schematic top view of a platen, and FIG. 3B shows a view taken along line B-B indicated by arrows in FIG. 3A.

FIG. 10A shows a front view of a carriage guide rail in a non-bent state, and FIG. 10B shows a front view of the carriage guide rail in a bent state.

DESCRIPTION OF EMBODIMENTS

Figure 1:
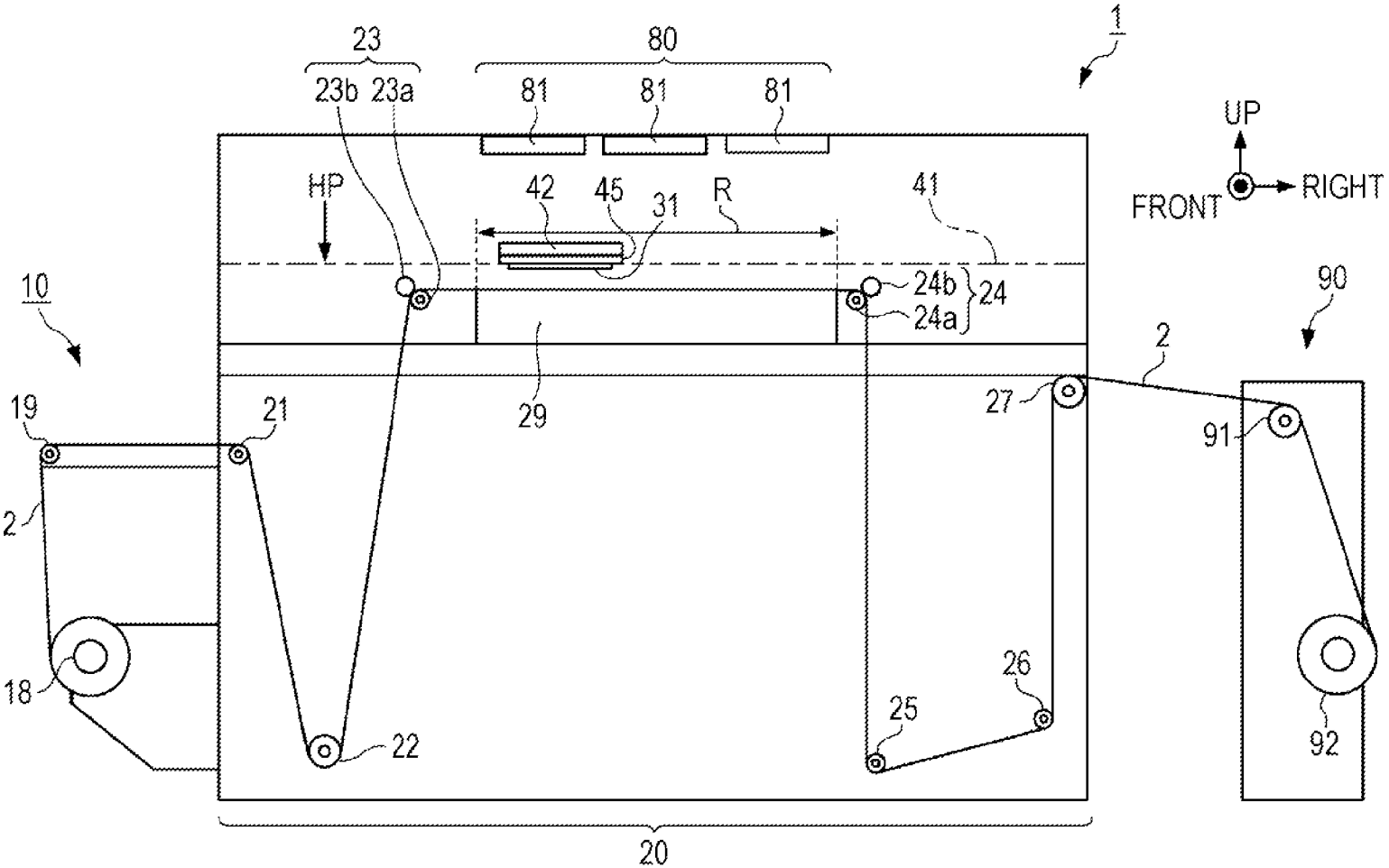
FIG. 1 is a schematic view showing a configuration of a printer.

Hereinafter, embodiments of the invention will be described with reference to accompanying drawings. In addition, the size of each layer or each member in the drawings is different from its actual size to make each layer or each member have a recognizable size.

===Regarding Printer 1===

A first embodiment of a printer 1 as an example of a fluid ejecting apparatus will be described with reference to FIGS. 1 and 2. FIG. 1 is a schematic cross-sectional view of the printer 1, and FIG. 2 is a block view of the printer 1.

Furthermore, in the following description, an "up-down direction" and a "right-left direction" are directions shown by arrows in FIG. 1. Further, in FIG. 1, a "front-rear direction" is a direction perpendicular to a plane of paper. Additionally, the "front-rear direction" is parallel to a paper width direction of a rolled paper sheet 2 as a printing object of printer 1. Thus, the front-rear direction is also referred to simply as the "paper width direction" in the following description. In addition, these up-down direction, right-left direction, and front-rear direction are perpendicular to one another. Moreover, a term "recording" that is used to describe "recording an image on the rolled paper sheet 2" is also referred to simply as "printing" in the following description.

The printer 1 causes the rolled paper sheet 2, as a recording medium, (continuous paper sheet) to be unwound and transported along a predetermined transport path. Then, the printer 1 causes an image to be printed on the rolled paper sheet 2 in a printing area R that is set at a predetermined position on the transport path. Subsequently, the rolled paper sheet 2 is rewound and treated as the image-printed rolled paper sheet 2.

Figure 2:
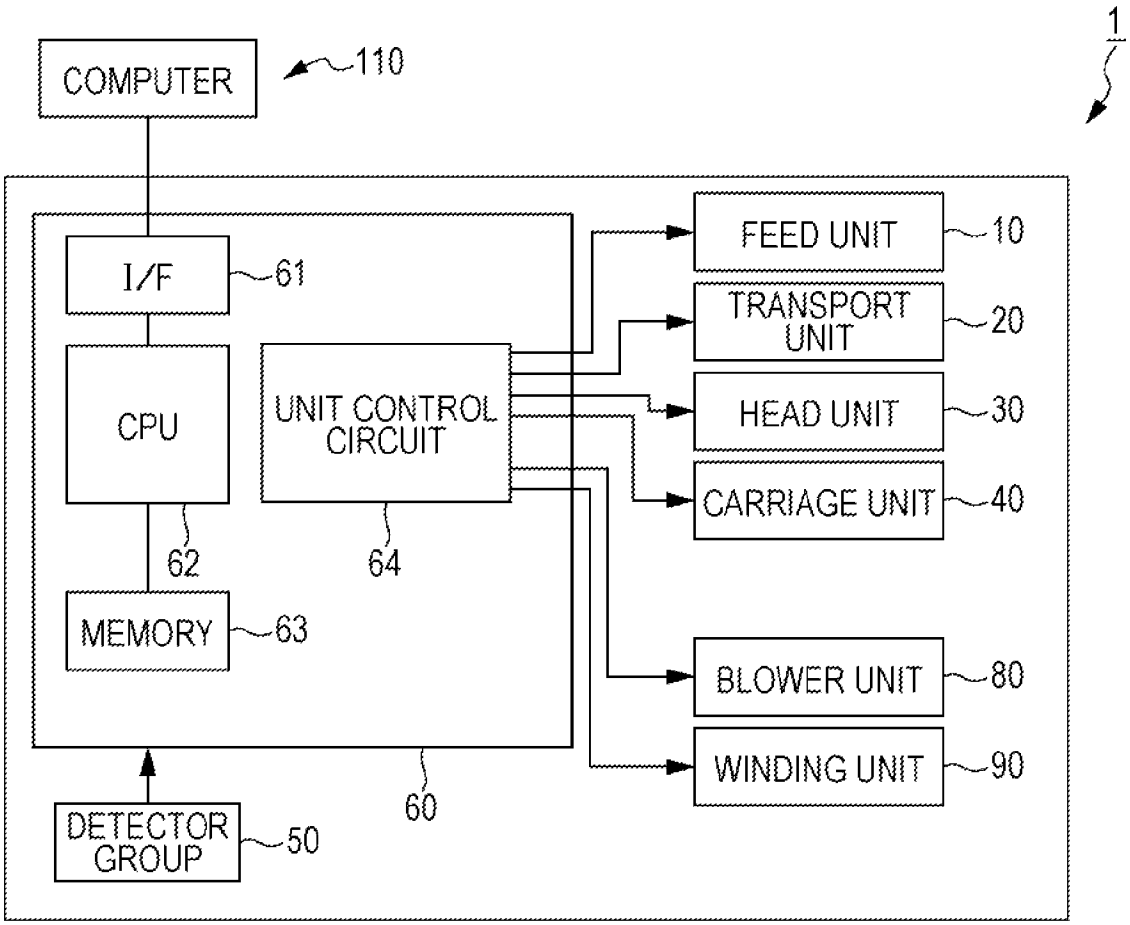
FIG. 2 is a block view showing a configuration of the printer.

As shown in FIGS. 1 and 2, the printer 1 has a feed unit 10, a transport unit 20, a platen 29 as a support portion, a winding unit 90, a head unit 30, a carriage unit 40, and a blower unit 80. Furthermore, the printer 1 has a controller 60 that manages an operation of the printer 1 by controlling these units 10, 20, 30, 40, 80, 90 and the like and a detector group 50. Hereinafter, details of these units and the like will be described.

The feed unit 10 feeds the rolled paper sheet 2 to the transport unit 20. This feed unit 10 has a winding shaft 18 that rotatably supports the rolled paper sheet 2 in a wound state, and a relay roller 19 around which the rolled paper sheet 2 unwound from the winding shaft 18 is wound and which introduces the rolled paper sheet 2 into the transport unit 20. Then, the feed unit 10 feeds the rolled paper sheet 2 to the transport unit 20, corresponding to a transport operation of the transport unit 20.

The transport unit 20 transports the rolled paper sheet 2 that is in an unwound state and sent from the feed unit 10 from an upstream side to a downstream side, along a predetermined transport path. This transport unit 20 has a plurality of relay rollers 21 and 22, a first transport roller 23, a second transport roller 24, and a plurality of relay rollers 25, 26 and 27, as shown in FIG. 1. The relay rollers 21 and 22 and the first transport roller 23 are disposed between the feed unit 10 and the platen 29. Meanwhile, the second transport roller 24 and the plurality of relay rollers 25, 26, and 27 are disposed between the platen 29 and the winding unit 90. Further, the rolled paper sheet 2 is laid over these rollers 21, 22, 23, 24, 25, 26, and 27 in order. In this way, the transport path of the rolled paper sheet 2 is formed. Additionally, this transport unit 20 is driven in cooperation with the feed unit 10 described above, and thus functions as a "transport portion" according to claims.

Each of the first and second transport rollers 23 (24) is constituted of a pair of rollers. In both the first and second transport rollers 23 (24), one roller 23*a* (24*a*) is constituted as a driving roller that is driven to rotate by a motor (not shown), and the other roller 23*b* (24*b*) is constituted as a driven roller that rotates in response to the rotation of the driving roller. Furthermore, when printing of an image is finished with respect to a part of the rolled paper sheet 2 which is positioned in the printing area R, a part of the rolled paper sheet 2 on which an image is printed is discharged from the printing area R by the first transport roller 23, the second transport roller 24, or the like. Subsequently, a new part of the rolled paper sheet 2 on which an image is not printed yet is supplied to the printing area R and supplying the new part is stopped. Further, when transporting of the rolled paper sheet 2 stops intermittently, an image is printed on the new part positioned in the printing area R. In other words, a printing operation with respect to the part of the rolled paper sheet 2 which is positioned in the printing area R and a transport operation of the rolled paper sheet 2 are repeatedly performed. This intermittent transport is carried out by the controller 60 by controlling rotation driving of the first transport roller 23 and the second transport roller 24.

Furthermore, in the transport path of the rolled paper sheet 2, the printing area R described above is set so as to correspond to an upper surface of the platen 29. In addition, a transport direction of the rolled paper sheet 2 in the printing area R is parallel to the right-left direction. Thus, in the printing area R, the right-left direction can be referred to simply as the "transport direction" and may also be expressed as the "transport direction" in the following description.

The head unit 30 prints an image on a part of the rolled paper sheet 2 that is sent to the printing area R on the transport path by ejecting ink as an example of a fluid. The head unit 30 has a head 31. Nozzle arrays that are constituted of a plurality of nozzles in a row are provided on a lower surface of the head 31. In this example, the nozzle arrays that are each constituted of a plurality of nozzles #1 to #N are provided so as to respectively correspond to yellow (Y), magenta (M), cyan (C), black (K), and other colors. Each nozzle group #1 to #N constituting each nozzle array is linearly aligned in the paper width direction (front-rear direction). In addition, the nozzle arrays are arranged in parallel so as to be spaced apart from one another in the transport direction (right-left direction) of the rolled paper sheet 2.

A piezoelectric element (not shown) as a driving element for ejecting ink is provided in each of the nozzles #1 to #N. Furthermore, the controller 60 controls the application of voltage to both ends of the piezoelectric element. Thereby ink droplets are ejected from each of the nozzles #1 to #N that corresponds to each color.

The carriage unit 40 causes the head 31 to move in the transport direction (right-left direction) and the paper width direction (front-rear direction) so as to print a two-dimensional image on the rolled paper sheet 2. This carriage unit 40 has a carriage guide rail 41 that extends in the transport direction (right-left direction), a carriage base 45 that is supported so as to reciprocatively move in the transport direction (right-left direction) along the carriage guide rail 41, and a carriage 42 that is supported by the carriage base 45. In addition, the carriage according to claims of this application includes the carriage 42 and the carriage base 45.

The carriage 42 supported by the carriage base 45 reciprocates, by the driving of a motor (not shown), in the transport direction (right-left direction) in a state of holding the head 31 integrally. In addition, a head carriage guide rail (not shown) that extends in the paper width direction (front-rear direction) is provided in the carriage 42. The head 31 is moved, along the head carriage guide rail, in the paper width direction (front-rear direction) by the driving of a motor (not shown). When the printing is carried out by the head 31, the carriage 42 that is supported by the carriage base 45 moves reciprocatively in the transport direction using the carriage guide rail 41 as a guide. When the carriage 42 stops between a forward path and a returning path, the head 31 is moved in the paper width direction by a predetermined distance d. By repeatedly performing these operation, a two-dimensional image is printed on a part of the rolled paper sheet 2 in the printing area R. The printing operation will be described below.

A home position HP is prepared for the carriage 42 that reciprocatively moves in the transport direction. The home position HP is a standby position at which the carriage 42 (head 31) stands by when the carriage 42 (head 31) does not perform the printing operation. During the transport operation where the rolled paper sheet 2 is transported, the carriage 42 is returned to the home position HP and stops, for example. The position of the home position HP is set to a position apart from the platen 29 in the transport direction (right-left direction). In this example, the home position HP is set to a position which is further on the upstream side (that is, a left side in the right-left direction) than the platen 29 in the transport direction.

The platen 29 supports a part of the rolled paper sheet 2 which is positioned in the printing area R. As described above, the platen 29 is provided in the printing area R. That is, the platen 29 is disposed between the first transport roller 23 and the second transport roller 24. In this example, the upper surface of the platen 29 is a support surface for the rolled paper sheet 2. In addition, the transport path of the rolled paper sheet 2 in the printing area R is a line-shaped route in the right-left direction. Thus, the upper surface of the platen 29 is formed in a planar shape in the right-left direction so as to correspond to the transport path.

A heater (not shown) is provided on the platen 29 to heat a part of the rolled paper sheet 2 which is positioned on the printing area R. The upper surface of the platen 29 is heated by the heater, and therefore the ink that lands on a part of the rolled paper sheet 2 which is on the platen 29 is immediately dried. The heater is, for example, a nichrome wire that is embedded in the platen 29. The heat quantity is controlled by applying electricity, and therefore the temperature of the rolled paper sheet 2 on the platen 29 is adjusted so as to be 45° C., for example. In addition, it may be configured that printing is performed at room temperature without providing a heater on the platen 29.

Figure 3A:
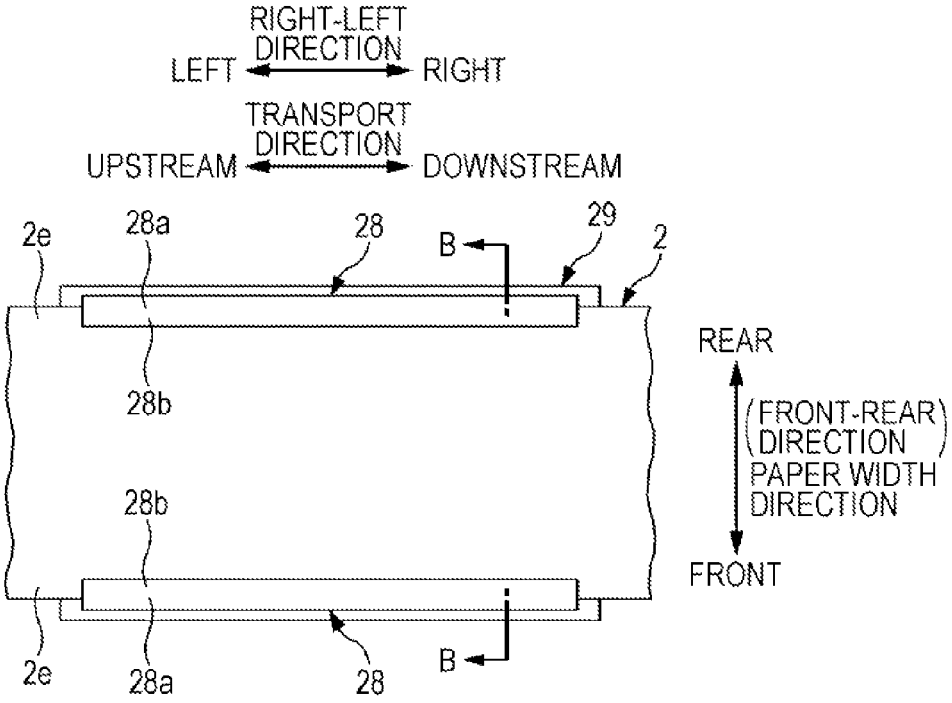
FIGS. 3A and 3B are explanatory views of a curl restraining member.
Figure 3B:
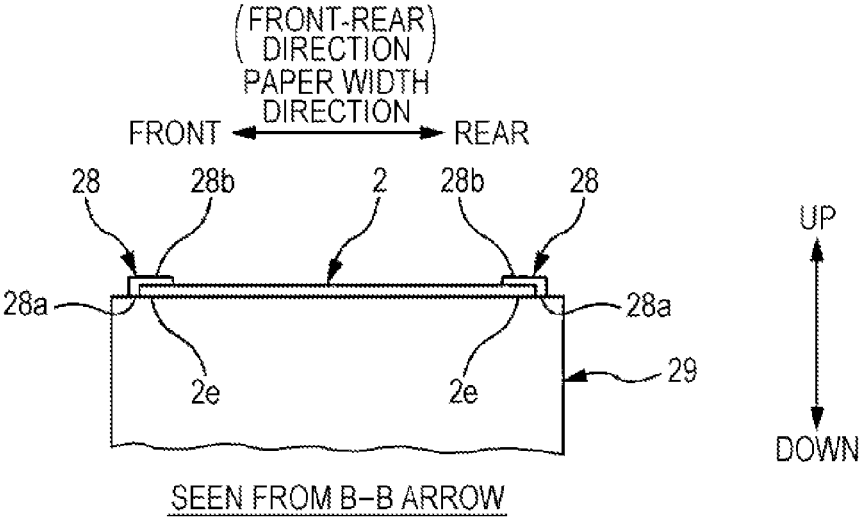

Furthermore, to suppress the curl of the rolled paper sheet 2 in the paper width direction and flatten the rolled paper sheet 2, a curl restraining member 28 is disposed on the upper surface of the platen 29. FIGS. 3A and 3B are explanatory views of the curl restraining member 28. FIG. 3A shows a schematic top view of the platen 29, and FIG. 3B shows a view taken along line B-B indicated by arrows in FIG. 3A. The curl restraining member 28 is constituted of band-shaped plate members 28 that are provided so as to correspond to respective end portions 2*e* and 2*e* of the rolled paper sheet 2 in the paper width direction. Further, in each band-shaped plate member 28, an outer portion 28*a* in the paper width direction (front-rear direction) abuts on and is fixed to the upper surface of the platen 29 and an inner portion 28*b* freely comes into contact with or separates from the upper surface of the platen 29. Therefore, the curl of the rolled paper sheet 2 is suppressed by inserting the end portion 2*e* of the rolled paper sheet 2 between the inner portion 28*b* and the upper surface of the platen 29. As a result, it is possible to suppress the interference of the rolled paper sheet 2 with the head 31 and stably print an image on the rolled paper sheet 2.

The blower unit 80 blows air toward the rolled paper sheet 2 on the platen 29. This blower unit 80 includes a fan 81 and a motor (not shown) to rotate the fan 81. The fan 81 is rotated and blows air to the rolled paper sheet 2 on the platen 29, and thereby the ink landed on the rolled paper sheet 2 is dried. Blowing air also has the effect of maintaining a constant surrounding environment, for example maintaining a constant air temperature distribution around a platen. A plurality of fans 81 described above are provided on a cover that is provided on a case of the printer 1 so as to be openable and closable. In addition, when the cover is closed, each fan 81 is positioned upward of the platen 29 such that each fan 81 is opposite to a part of the rolled paper sheet 2 which abuts on and is supported by the platen 29.

The winding unit 90 winds a printed part of the rolled paper sheet 2 that is sent by the transport unit 20. The winding unit 90 has a relay roller 91 around which the rolled paper sheet 2 sent from the relay roller 27 that is on the most downstream side of the transport unit 20 is wound and a winding shaft 92 that winds the rolled paper sheet 2 sent from the relay roller 91. The winding shaft 92 is driven to rotate by a motor (not shown) so as to correspond to the transport operation of the transport unit 20. Thereby, the rolled paper sheet 2 sent from the transport unit 20 is quickly wound.

The controller 60 is a control unit to control the printer 1. This controller 60 has an interface portion 61, a CPU 62, a memory 63, and a unit control circuit 64, as shown in FIG. 2. The interface portion 61 conducts transmission and reception of data between the printer 1 and a host computer 110 that is an external device. The CPU 62 is a processing unit to control the entire printer 1. The memory 63 ensures an area to store programs for the CPU 62 and a working area. The CPU 62 controls respective units 10, 20, 30, 40, 80, 90, and the like using a unit control circuit 64 that follows the program stored in the memory 63.

The detector group 50 monitors the status of the printer 1 and includes a rotary type encoder that is used to control the transport operation of the rolled paper sheet 2 installed on the first and second transport rollers 23 and 24, for example, a paper sheet detecting sensor that detects the presence or absence of the rolled paper sheet 2 to be transported, a linear type encoder that detects the position of the carriage 42 (or the head 31) in the transport direction (right-left direction), a rolled paper sheet abnormal portion detecting sensor 52 (see FIG. 6) that detects an abnormal portion on the rolled paper sheet 2, such as foreign matter adhering to the rolled paper sheet 2, and the like. In addition, the detection result from the detector group 50 is transmitted to the controller 60. The controller 60 controls, based on the detection result, respective units 10, 20, 30, 40, 80, 90, and the like. Furthermore, details of a configuration of the rolled paper sheet abnormal portion detecting sensor 52 that is a principal portion in the printer 1 of the invention will be described below.

===Regarding Printing Operation of Printer 1===

As described above, the printer 1 has the head 31, and the nozzle array constituted of the nozzles aligned in the paper width direction (front-rear direction) is provided on the head 31. In addition, the controller 60 causes the head 31 to move in the transport direction (right-left direction) and eject ink from the nozzle, so that a raster line is formed along the transport direction (right-left direction). Thereby, an image is printed on a part of the rolled paper sheet 2 which is positioned in the printing area R. Furthermore, to make it easy to explain, it is assumed that the number of the nozzle arrays on the head 31 is one in the following description. However, as described above, the actual number of the nozzle arrays is plural so as to correspond to C, M, Y, K and other colors.

Subsequently, the controller 60 executes printing with plural paths (six paths, eight paths, and 16 paths, for example). In other words, to increase the resolution of an image in the paper width direction (front-rear direction), printing is carried out so that the position of the head 31 in the paper width direction for every other path is changed little by little. In addition, a well-known interlace (microwave) printing method is adopted as a method for printing.

Figure 4:
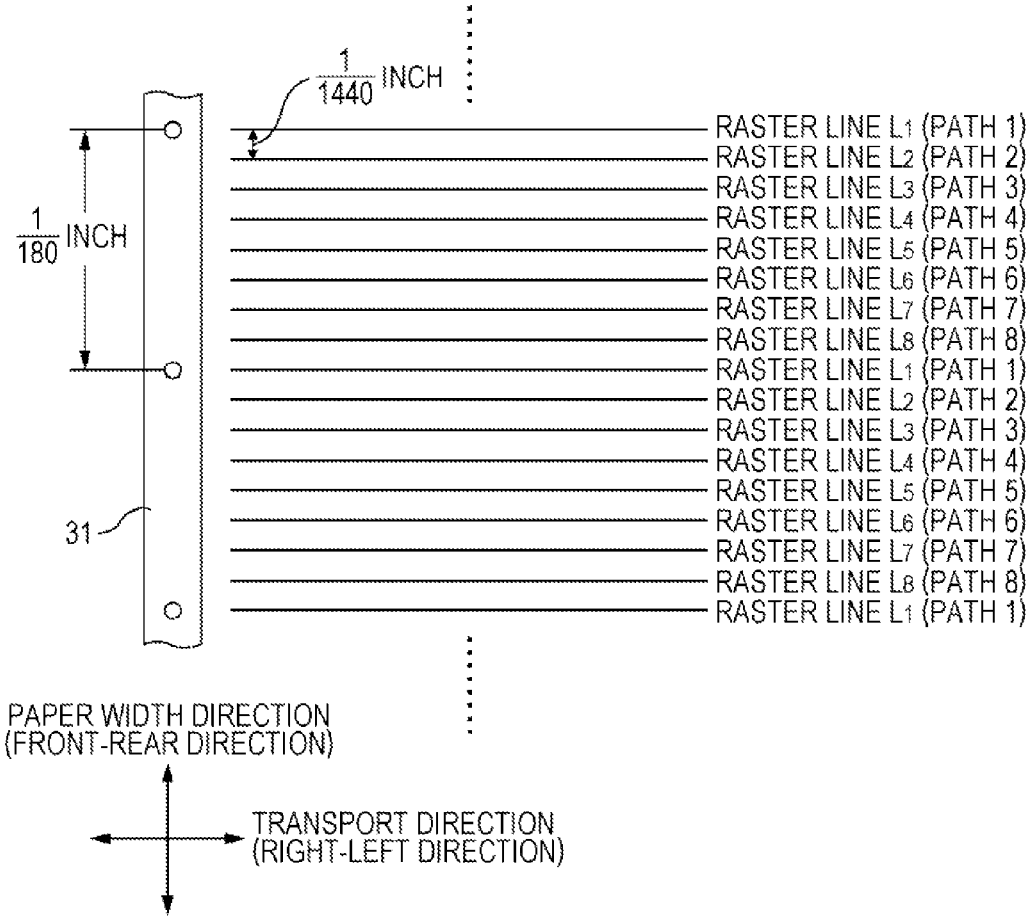
FIG. 4 is an explanatory view of a printing operation and is a schematic view showing raster lines that are formed in respective paths when printing is carried out in eight paths.

Details of a printing operation will be described with reference to FIG. 4. FIG. 4 is a schematic view showing raster lines that are formed in respective paths when printing is carried out with eight paths.

The nozzle array (nozzles) on the head 31 is illustrated on the left side in FIG. 4. The head 31 (nozzle array) moves in the transport direction (right-left direction) and ejects ink from the nozzles, and therefore the raster line is formed. The position of the head 31 (nozzle array) in the paper width direction (front-rear direction), which is illustrated in FIG. 4, is a position in a first path. When the head 31 (nozzle array) maintains the position and moves in the transport direction, a first path printing is performed, and therefore three raster lines (raster lines L1, at the right end of which path 1 is written) shown in FIG. 4 are formed.

Next, the head 31 (nozzle array) moves in the paper width direction, and the head 31 (nozzle array) maintains the position after the movement. Then, when the head 31 (nozzle array) moves in the transport direction, a second path printing is performed, and therefore two raster lines (raster lines L2, at the right end of which path 2 is written) shown in FIG. 4 are formed. Furthermore, a raster line L2 adjacent to a raster line L1 is formed by ink ejected from a nozzle that is different from a nozzle which ejects ink for forming the raster line L1, because an interlace (microwave) printing method is adopted. Thus, the moving distance of the head 31 (nozzle array) in the paper width direction is not set to 1/8 (1/180×1/8=1/1440 inch) of the distance between the nozzles (1/180 inch, for example) but set to a distance (hereinafter, the distance is represented by a distance d) greater than that.

Subsequently, third to eighth paths printing is performed by the operations which are similar to the operations described above, and therefore the other raster lines (raster lines L3 to L8, at the right ends of which paths 3 to 8 are written, respectively) illustrated in FIG. 4 is formed. In this way, the raster lines are formed in eight paths, and thus the resolution of an image in the paper width direction can be improved by as much as eight times (=1440÷180) what it was.

In the embodiment, a so-called bidirectional printing method is adopted. In other words, the movement direction of the head 31 (nozzle array) when the first path, the third path, the fifth path, or the seventh path printing is performed is opposite to the movement direction of the head (nozzle array) when the second path, the fourth path, the sixth path, or the eighth path printing is performed.

Figure 5:
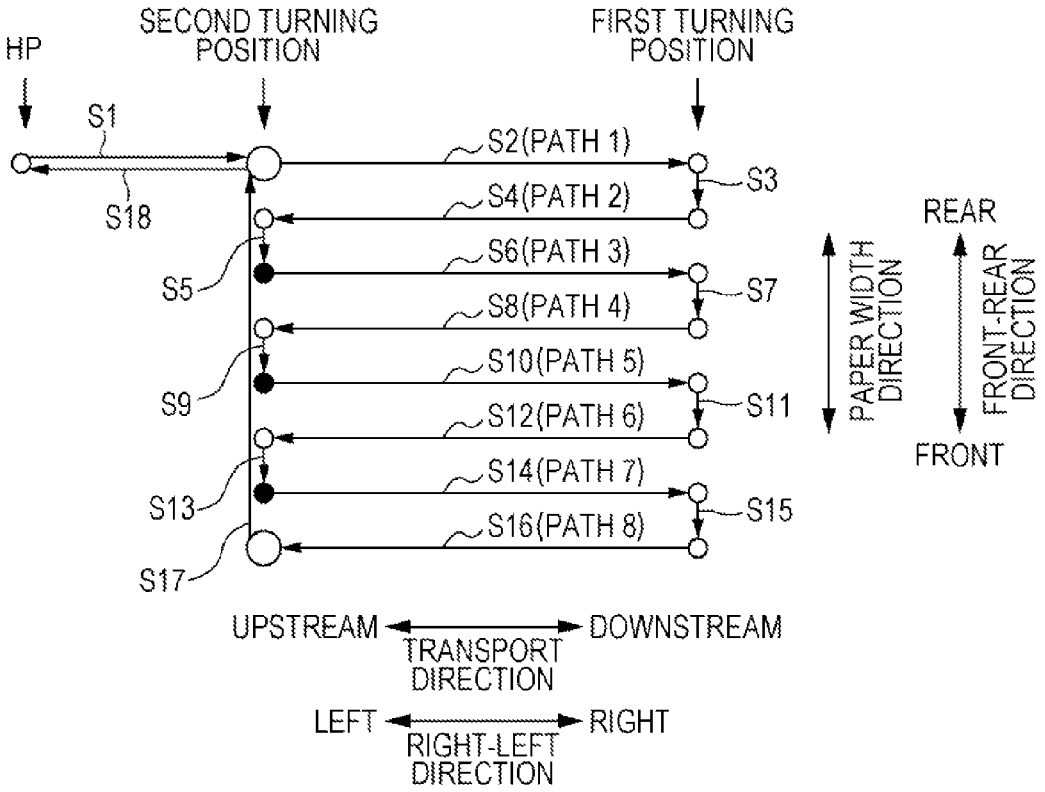
FIG. 5 is a schematic view that shows a movement of a head in a printing operation.

FIG. 5 is an explanatory view of this bidirectional printing and is a schematic view showing the movement of the head 31.

First, how to read FIG. 5 will be explained. FIG. 5 shows how the head 31 moves during the printing operation of the bidirectional printing. For convenience, the head 31 is represented by a circle, and the movement of the head 31 is represented by an arrow. Here, in FIG. 5, an arrow facing the right-left direction shows the movement of the head 31 in the transport direction (that is, a first movement direction), and an arrow facing the up-down direction shows the movement of the head 31 in the paper width direction (that is, a second movement direction). Furthermore, reference signs S1 to S18 are given to respective arrows. The reference sign is a step number which is used in the following description of the printing operation.

In addition, there are step numbers to which paths 1 to 8 are respectively assigned. These step numbers shows steps of ejecting ink, namely image printing steps.

Hereinafter, the printing operation of the bidirectional printing will be described with reference to FIGS. 4 and 5. Also, the printing operation is mainly executed by the controller 60. In the embodiment, specifically, the printing operation is performed by causing the CPU 62 to process a program stored in the memory 63. This program is constituted of codes to perform various operations described below.

When the rolled paper sheet 2 stops due to the intermittent transport of the rolled paper sheet 2 described above, the printing operation is to start to print an image on a part of the rolled paper sheet 2 which is positioned in the printing area R.

First, the controller 60 causes the head 31 to move, from the home position HP, in a forward direction (a right direction in terms of the right-left direction, and a direction from the upstream side to the downstream side in terms of the transport direction) (step S1). Then, when the head 31 enters the printing area R, the controller 60 executes the first path printing to cause the head 31 to eject ink (step S2). By this operation, the raster line L1 (raster line of path 1) shown in FIG. 4 is formed.

When the head 31 arrives at a first turning position, the controller 60 causes the head 31 to move forward in the paper width direction (step S3). In this example, the head 31 moves forward by the distance d described above.

Then, the controller 60 causes the head 31 to move in a returning direction (a left direction in terms of the right-left direction, and a direction from the downstream side to the upstream side in terms of the transport direction). At the same time, the controller 60 causes the head 31 to eject ink. In this way, the controller 60 executes the second path printing (step S4). Therefore, the raster line L2 (raster line of path 2) shown in FIG. 4 is formed.

Next, when the head 31 arrives at a second turning position, the controller 60 causes the head 31 to move forward in the paper width direction (step S5). In this example, the head 31 moves forward by the distance d described above.

When the movement thereof is finished, the controller 60 executes two more times the same processes as steps S2 to S5 (steps S6 to S9 and steps S10 to S13). In a first process, the raster line L3 (a raster line of path 3) shown in FIG. 4 is formed by the third path printing (step S6), and the raster line L4 (a raster line of path 4) shown in FIG. 4 is formed by the fourth path printing (step S8).

Further, in a second process, the raster line L5 (a raster line of path 5) shown in FIG. 4 is formed by the fifth path printing (step S10), and the raster line L6 (a raster line of path 6) shown in FIG. 4 is formed by the sixth path printing (step S12).

Subsequently, the controller 60 executes printing for the last two paths. In other words, the controller 60 causes the head 31 to move in the forward direction and causes the head 31 to eject ink. In this way, the controller 60 executes the seventh path printing (step S14). Therefore, the raster line L7 (raster line of path 7) shown in FIG. 4 is formed. When the head 31 arrives at the first turning position, the controller 60 causes the head 31 to move forward in the paper width direction (step S15). In this example, the head 31 moves forward by the distance d described above. Then, the controller 60 causes the head 31 to move in the returning direction and causes the head 31 to eject ink. In this way, the controller 60 executes the eighth path printing (step S16). Therefore, the raster line L8 (raster line of path 8) shown in FIG. 4 is formed.

Next, when the head 31 arrives at the second turning position, the controller 60 causes the head 31 to return to the starting point in the paper width direction (step S17). In other words, the controller 60 causes the head 31 to move, by the distance 7*d*, in a direction that is opposite the moving direction of head 31 in steps S3, S5, S7, S9, S11, S13, and S15, namely a backward direction in the paper width direction.

Then, the controller 60 causes the head 31 to move from the second turning position to the upstream side in the transport direction, such that the head 31 returns to the home position HP (step S18). Therefore, the image printing operation is completed.

Incidentally, the reciprocation of the head 31 in the transport direction (right-left direction) is carried out in the manner that the carriage 42 reciprocates in the transport direction. In contrast, the movement of the head 31 in the paper width direction (front-rear direction) is carried out in the manner that the head 31 moves, relative to the carriage 42, in the paper width direction.

===Regarding Rolled Paper Sheet Abnormal Portion Detecting Sensor 52===

Figure 6:
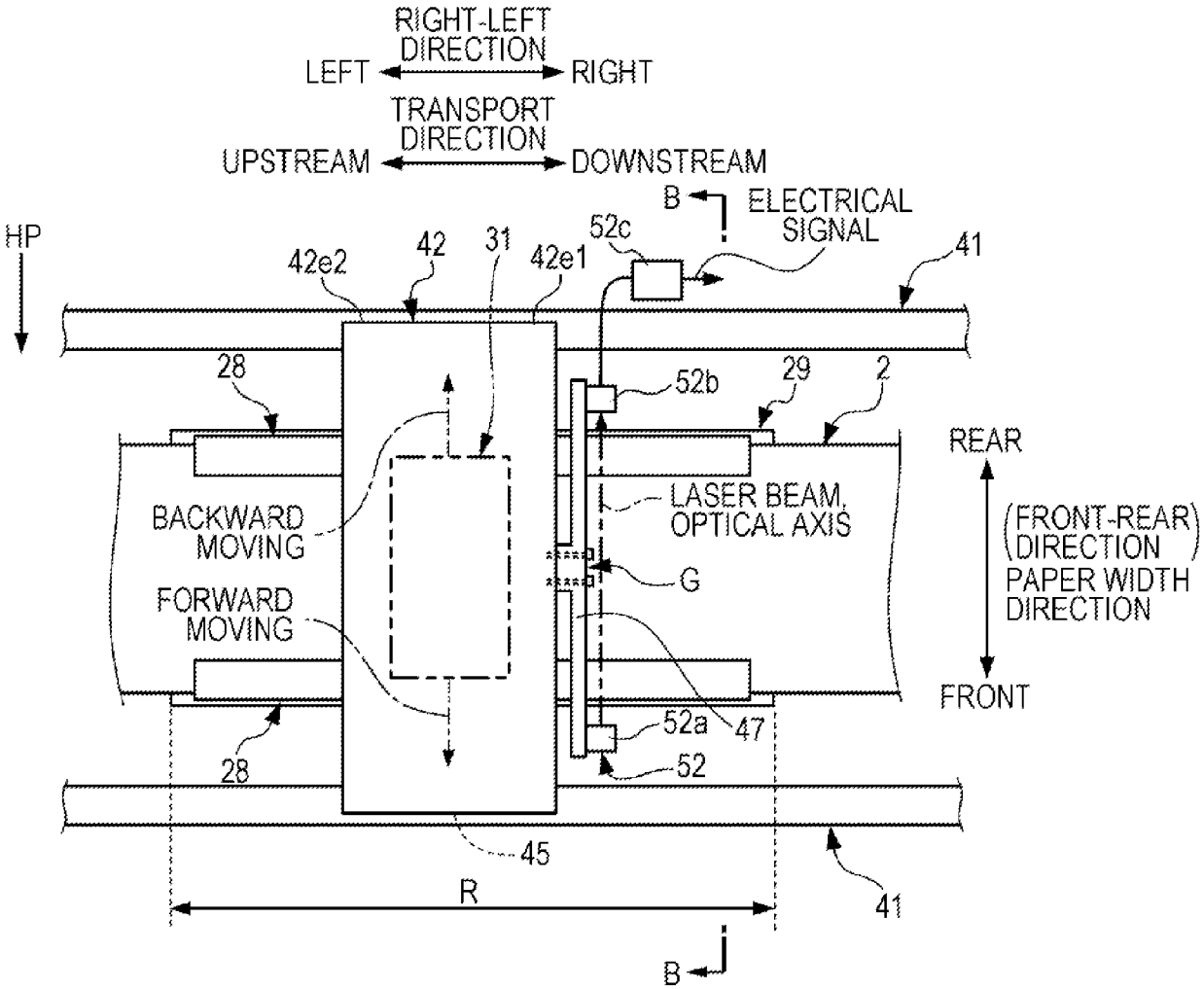
FIG. 6 is an explanatory view of a rolled paper abnormal portion detecting sensor and is an enlarged plan view of a carriage in a state of moving in a printing area R.
Figure 7:
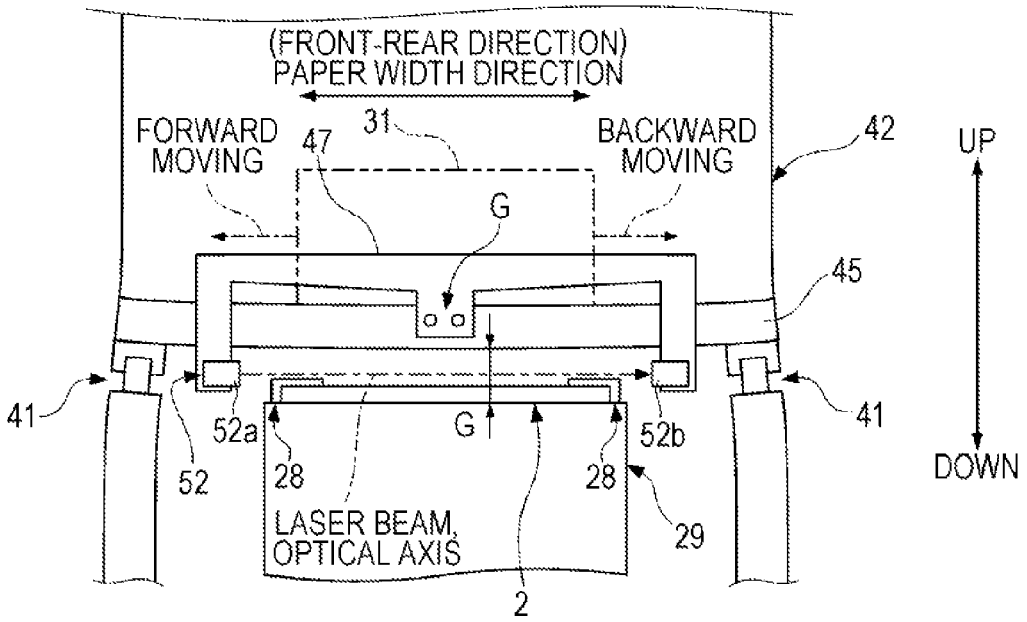
FIG. 7 is an explanatory view of the rolled paper abnormal portion detecting sensor and is a view taken along line B-B indicated by arrows in FIG. 6.

FIGS. 6 and 7 are explanatory views of the rolled paper sheet abnormal portion detecting sensor 52. FIG. 6 is an enlarged plan view of the carriage 42 in a state of moving in the printing area R, and FIG. 7 is a view taken along line B-B indicated by arrows in FIG. 6.

The principle that the head 31 in the printing operation moves, over the platen 29 in the printing area R, in the transport direction or the paper width direction is described above. However, in this case, the size of a gap G that is between the upper surface of the platen 29 and the lower surface of the head 31 is as narrow as the order of millimeters between about one mm and several mm, as shown in FIG. 7. Thus, if the foreign matter adheres to the rolled paper sheet 2 to be printed and the rolled paper sheet 2 swells up toward the head 31 or if the rolled paper sheet 2 is partially torn and rises toward the head 31, the abnormal portion, such as the foreign matter or the torn portion, can come into contact with or interfere with head 31 in a printing state. Therefore, the head 31 can be damaged.

For this reason, the rolled paper sheet abnormal portion detecting sensor 52 that detects an abnormal portion on the rolled paper sheet 2 is mounted on the printer 1. As shown in FIGS. 6 and 7, this rolled paper sheet abnormal portion detecting sensor 52 is fixed to the carriage base 45 via a sensor mounting member 47. In other words, the rolled paper sheet abnormal portion detecting sensor 52 is integrally fixed to the carriage 42 so as to be immovable relative to the carriage 42. Therefore, the rolled paper sheet abnormal portion detecting sensor 52 that is integrated with the carriage 42 reciprocates in the transport direction, namely the right-left direction. In other words, the rolled paper sheet abnormal portion detecting sensor 52 reciprocates in the transport direction, together with the carriage 42. Normally, during the movement of the carriage 42, namely over the entire period of the printing operation, the rolled paper sheet abnormal portion detecting sensor 52 enters an operation state by the control from the controller 60 and detects the abnormal portion on the rolled paper sheet 2.

The rolled paper sheet abnormal portion detecting sensor 52 is an optical sensor and constituted of a light emitting portion 52*a* that is disposed on one end side (front side in an example shown) in the paper width direction and a light receiving portion 52*b* that is arranged so that a laser beam, as an example of a light beam emitted from the light emitting portion 52*a*, is received on the other end side (rear side in the example shown) in the paper width direction. Furthermore, a position of an optical axis of the laser beam in the up-down direction is adjusted to be positioned between the lower surface of the head 31 and an upper surface of the rolled paper sheet 2 (that is, a surface facing the head 31 or a surface not facing the platen 29).

Thus, in a case where an abnormal portion, such as the foreign matter, is present on the upper surface of the rolled paper sheet 2 in a transport stop state, when the rolled paper sheet abnormal portion detecting sensor 52 that moves, together with the carriage 42, in the transport direction (right-left direction) passes through the abnormal portion, a laser beam emitted from the light emitting portion 52*a* is blocked by the abnormal portion. As a result, the light receiving state of the light receiving portion 52*b* is changed. In other words, an amount of light received by the light receiving portion 52*b* is reduced. Thus, the presence or absence of an abnormal portion is detected by monitoring the light receiving amount. For example, an amount of light received is converted into an electrical signal, such as voltage or current, by an adequate converter 52*c* embedded in the rolled paper sheet abnormal portion detecting sensor 52, and the electrical signal is almost continuously transmitted to the controller 60. When the electrical signal is below a predetermined threshold value which is, for example, an electrical signal value set in advance, the controller 60 determines that "an abnormal portion is present". In this case, the controller 60 causes the carriage 42 to stop, and then causes the carriage 42 to return to the home position HP. In this way, the abnormal portion is prevented from coming into contact with or interfering with the head 31, before it happens.

Incidentally, when the rolled paper sheet 2 is transported into the printing area R, the carriage 42 stands by at the home position HP shown in FIG. 1 (or FIG. 6). The home position HP is positioned outside the printing area R. Thus, even when a part of the rolled paper sheet 2 having an abnormal portion is transported into the printing area R, the abnormal portion does not interfere with the head 31 in the carriage 42 during the transport.

The rolled paper sheet abnormal portion detecting sensor 52 is provided on at least one of two end portions 42*e*1 and 42*e*2 of the carriage 42 in the transport direction (right-left direction). In a case where the rolled paper sheet abnormal portion detecting sensor 52 is provided on only one end portion, as an example shown in FIG. 6, the rolled paper sheet abnormal portion detecting sensor 52 is installed on the end portion 42*e*1 that can arrive at an abnormal portion before the head 31 arrives thereat during the first path printing operation, namely the first movement of the carriage 42 in the right-left direction. In the example shown in FIG. 6, for example, the right end portion 42*e*1 (end portion 42*e*1 on the downstream side, in terms of the transport direction) of the carriage 42 can arrive at a part of the rolled paper sheet 2 which is on the platen 29 before the head 31 arrives thereat, because the home position HP is positioned further left than the platen 29 in the right-left direction (further on the upstream side than the platen 29, in terms of the transport direction). Thus, the rolled paper sheet abnormal portion detecting sensor 52 is installed on the right end portion 42*e*1 of the carriage (end portion 42*e*1 on the downstream side, in terms of the transport direction).

Hereinafter, details of a method for fixing the rolled paper sheet abnormal portion detecting sensor 52, which is the most important configuration of the printer 1 according to the invention, will be described.

As shown in FIGS. 6 and 7, the light emitting portion 52*a* and the light receiving portion 52*b* that constitute the rolled paper sheet abnormal portion detecting sensor 52 are fixed to the carriage base 45 via the sensor mounting member 47. In the embodiment, the light emitting portion 52*a* and the light receiving portion 52*b* are mounted, spaced apart from each other at a predetermined interval, on a single sensor mounting member 47. The sensor mounting member 47 on which the light emitting portion 52*a* and the light receiving portion 52*b* are mounted is fixed to the carriage base 45 at a fixing position G, which is close to the center of the area between the pair of carriage guide rails 41 that are respectively disposed on both sides of the carriage base 45 so as to interpose the platen 29 therebetween. Therefore, it is possible for the rolled paper sheet abnormal portion detecting sensor 52 to have a configuration in which the laser beam emitted from the light emitting portion 52*a* is certain to be received by the light receiving portion 52*b*, and therefore an abnormal portion on the rolled paper sheet 2 can be reliably detected. Hereinafter, it will be described how an abnormal portion is reliably detected.

Figure 10A:
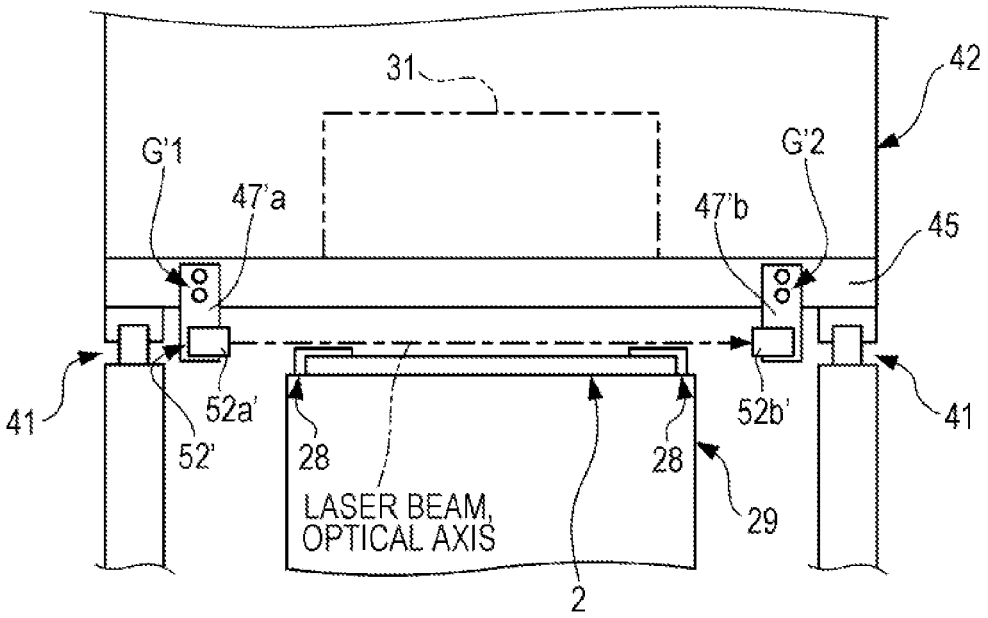
FIGS. 10A and 10B explain failure of a structure for mounting a rolled paper sheet abnormal portion detecting sensor, which differs from those of embodiments.

Failure that can be caused when the fixing position of the light emitting portion 52*a* and the light receiving portion 52*b* of the rolled paper sheet abnormal portion detecting sensor 52 are not accurately specified, as in this embodiment, will be described with reference to the drawings. FIG. 10 explains failure of a structure for mounting the rolled paper sheet abnormal portion detecting sensor 52, which differs from those of the embodiments. FIG. 10A shows a front view of a carriage guide rail 41 in a non-bent state, and FIG. 10B shows a front view of a carriage guide rail in a bent state.

Figure 10B:
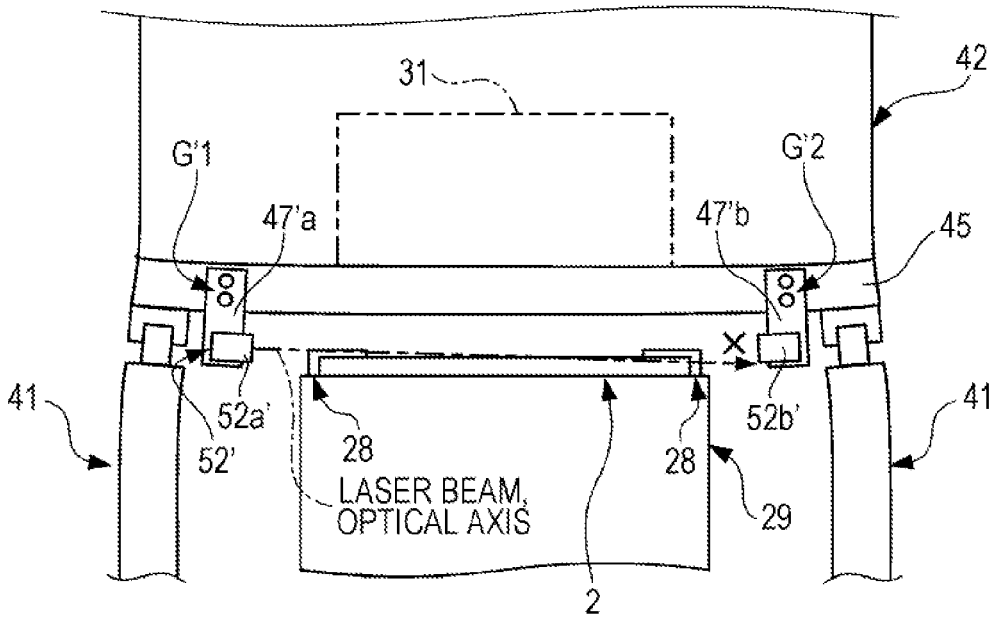

In a structure for mounting a rolled paper sheet abnormal portion detecting sensor 52' shown in FIG. 10, a light emitting portion 52*a*' is mounted on the carriage base 45 via a sensor mounting member 47*a*', and a light receiving portion 52*b*' is mounted on the carriage base 45 via a sensor mounting member 47*b*'. In this structure, respective sensor mounting members 47*a*' and 47*b*' are fixed to the carriage base 45 at fixing positions G'1 and G'2, which are in the vicinity of the area just above the carriage guide rail 41. In a case where the light emitting portion 52*a*' and the light receiving portion 52*b*' are fixed at these fixing positions G'1 and G'2, there is a high possibility that the positions of the light emitting portion 52*a*' and the light receiving portion 52*b*' are displaced by the influence of the carriage guide rail 41. It is difficult to maintain the processing accuracy of the carriage guide rail 41 as an apparatus increases in size. In addition, the shape thereof is likely to be changed by bending, distortion, or the like. Particularly, when a weight of the head 31 and the carriage (including the carriage base 45) that supports the head 31 increases owing to improvement in a drawing function, the carriage guide rail 41 is likely to be bent or distorted. Furthermore, when the carriage guide rail is bent or distorted, the state of the carriage base 45 that is disposed in the vicinity of the area just above the carriage guide rail 41 is changed due to the head 31 (carriage 42) positioned on the carriage guide rail 41. Even in a case where the optical axis is adjusted such that, in a non-bent state of the carriage guide rail 41, a laser beam emitted from the light emitting portion 52*a*' of the rolled paper sheet abnormal portion detecting sensor 52 can be received by the light receiving portion 52*b*', as shown in FIG. 10A, for example, if the carriage guide rail 41 is bent, as shown in FIG. 10B, the light emitting portion 52*a*' and the light receiving portion 52*b*' that are each fixed at the fixing position G'1 and G'2, via the sensor mounting members 47*a*' and 47*b*', which are in the vicinity of the area just above the carriage guide rail 41, are displaced. Therefore, the laser beam emitted from the light emitting portion 52*a*' cannot be correctly received by the light receiving portion 52*b*' and this results in the failure that an abnormality of the rolled paper sheet 2 on the platen 29 cannot be detected accurately.

In contrast, the structure for mounting the rolled paper sheet abnormal portion detecting sensor 52 of the embodiment, which is shown in FIGS. 6 and 7, are configured so that the sensor mounting member 47 on which the light emitting portion 52*a* and the light receiving portion 52*b* are mounted is fixed to the carriage base 45 at the fixing position G, which is close to the center of the area between the pair of carriage guide rails 41 that are respectively disposed on both sides of the carriage 42 so as to interpose the platen 29 therebetween. Therefore, even when the carriage guide rail 41 is bent, the light emitting portion 52*a* and the light receiving portion 52*b* are hardly influenced. Thus it is possible for the rolled paper sheet abnormal portion detecting sensor 52 to detect an abnormality on the rolled paper sheet 2 supported on the platen 29 with high accuracy.

Furthermore, in the embodiment, the supporting structure for the rolled paper sheet abnormal portion detecting sensor 52 is configured so that the light emitting portion 52*a* and the light receiving portion 52*b* are mounted, spaced apart from each other at the predetermined interval, on the integrated sensor mounting member 47 and a section of the sensor mounting member 47 which is close to the center of the area between the light emitting portion 52*a* and the light receiving portion 52*b* is fixed to the carriage base 45 at the fixing position G which is close to the center of the area between the pair of carriage guide rails 41. Thus, the positional relationship between the light emitting portion 52*a* and the light receiving portion 52*b* is set such that the light emitting portion 52*a* and the light receiving portion 52*b* are subjected to less influence caused by the bending of the carriage guide rail 41. As a result, it is possible to detect an abnormal portion on the rolled paper sheet 2 with high detection accuracy.

Next, details of the rolled paper sheet abnormal portion detecting sensor 52 will be described to place a focus on an operation for detecting an abnormal portion on the rolled paper sheet 2 as a recording medium.

Figure 8A:
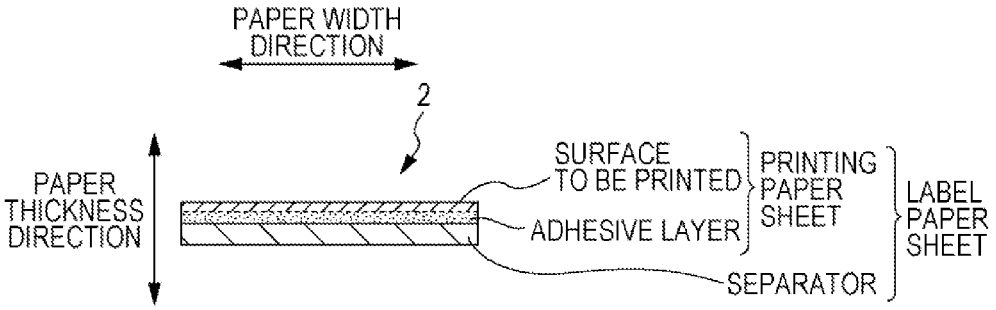
FIG. 8A is a longitudinal cross-sectional view of a label paper sheet as a rolled paper sheet.
Figure 8B:
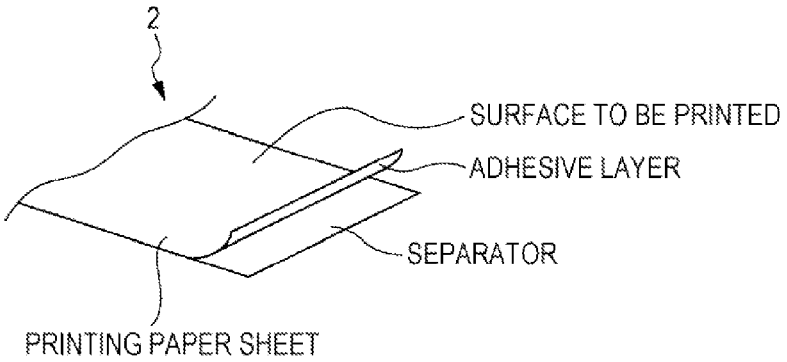
FIG. 8B is a perspective view of the label paper sheet.

In the embodiment, a label paper sheet is used as the rolled paper sheet (recording medium) 2. FIG. 8A is a longitudinal cross-sectional view of a label paper sheet, and FIG. 8B is a perspective view of the label paper sheet. The label paper sheet is also commonly referred to as a seal paper sheet. That is, a label paper sheet has a printing paper sheet (corresponding to recording material) in which the opposite side of a printing target surface for an image is an adhesive layer and a separator (peeling material) that is provided to cover the adhesive layer. In addition, it is easy to separate the separator from the printing paper sheet. When using the printed rolled paper sheet 2, an end user peels off the separator from the printing paper sheet and attaches it to a desired object. The printing paper sheet and the separator are not limited to being formed from any kind of paper, and may be formed from a resin film or the like.

When the rolled paper sheet 2, such as a label paper sheet, is set to the printer 1, the rolled paper sheet 2 is set in the printing area R such that the printing paper sheet side faces the head 31 and the separator side faces the platen 29.

Figure 9A:
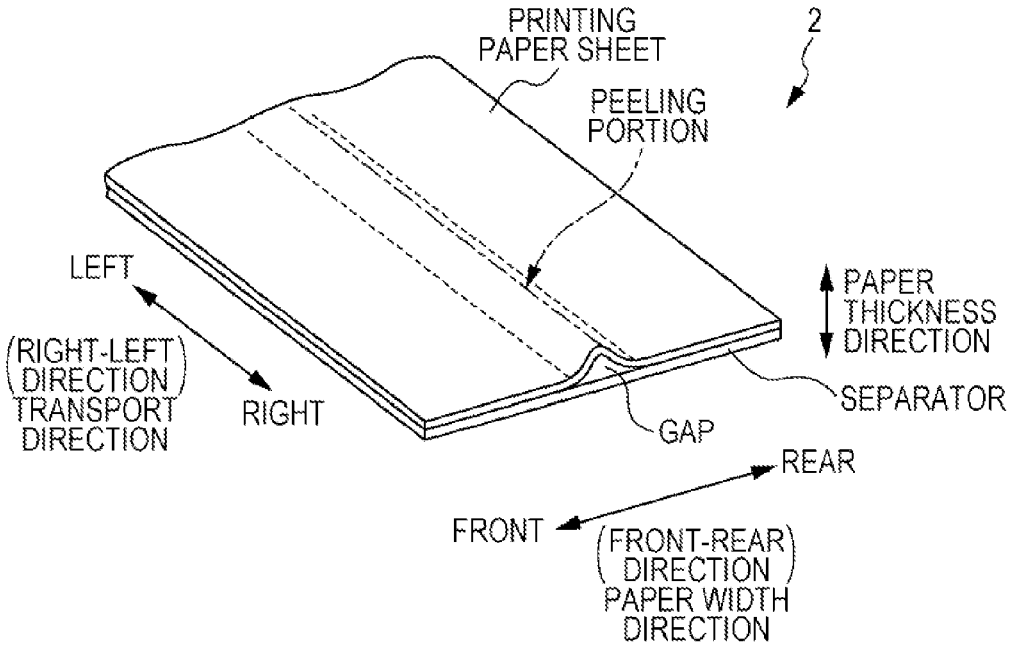
FIGS. 9A and 9B are perspective views of peeling portions that are examples of an abnormal portion on a rolled paper sheet.
Figure 9B:
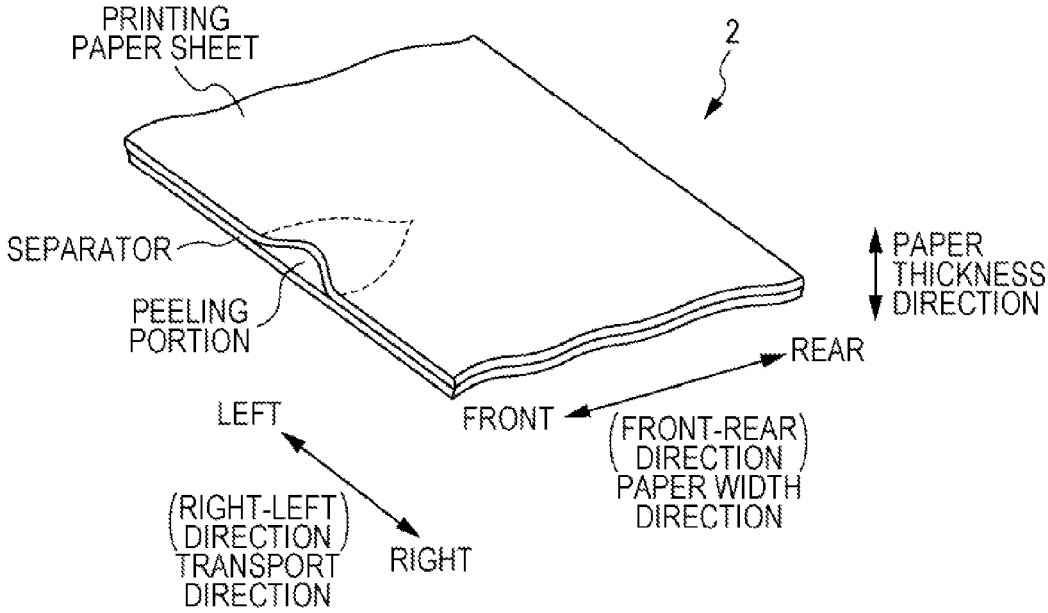

When the rolled paper sheet 2, such as a label paper sheet, is unwound, a peeling portion can be caused by partial peeling-off of the recording paper sheet from a separator. FIGS. 9A and 9B are perspective views of a general example of peeling portions. As shown in FIGS. 9A and 9B, the peeling portion swells up, in a paper thickness direction, by a gap that is formed, due to the partial peeling-off described above, between the separator and the printing paper sheet. In many cases, the peeling portion has a linear shape parallel to the right-left direction, namely the transport direction, as shown in FIG. 9A or the peeling portion is formed in either end portion of the rolled paper sheet 2 in the front-rear direction, namely the paper width direction, as shown in FIG. 9B. In other cases, the peeling portion that is in the direction shown in FIG. 9B may be formed linearly so as to be parallel to the front-rear direction, namely the paper width direction of the rolled paper sheet 2 (that is, the peeling portion is linearly formed so as to cross both one end portion and the other end portion in the front-rear direction, namely the paper width direction).

Regardless of what shape the peeling portion is formed in, the peeling portion has an excessive thickness, up to as thick as the swelling portion, compared to the original thickness of the label paper sheet. Therefore, there is a possibility that, during printing, the peeling portion may come into contact with or interfere with the head 31 and damage the head 31. For this reason, the rolled paper sheet abnormal portion detecting sensor 52 described above also detects this peeling portion as an abnormal portion on the rolled paper sheet 2. That is, the peeling portion that is formed as shown in FIG. 9A or FIG. 9B can be detected as follows. When the rolled paper sheet abnormal portion detecting sensor 52 moves in the right-left direction, namely the transport direction, and passes through the peeling position, the light beam emitted is reliably blocked for a certain period, and therefore an amount of light received is greatly reduced. Therefore, it is possible to detect the peeling portion.

===Another Embodiment===

Figure 11:
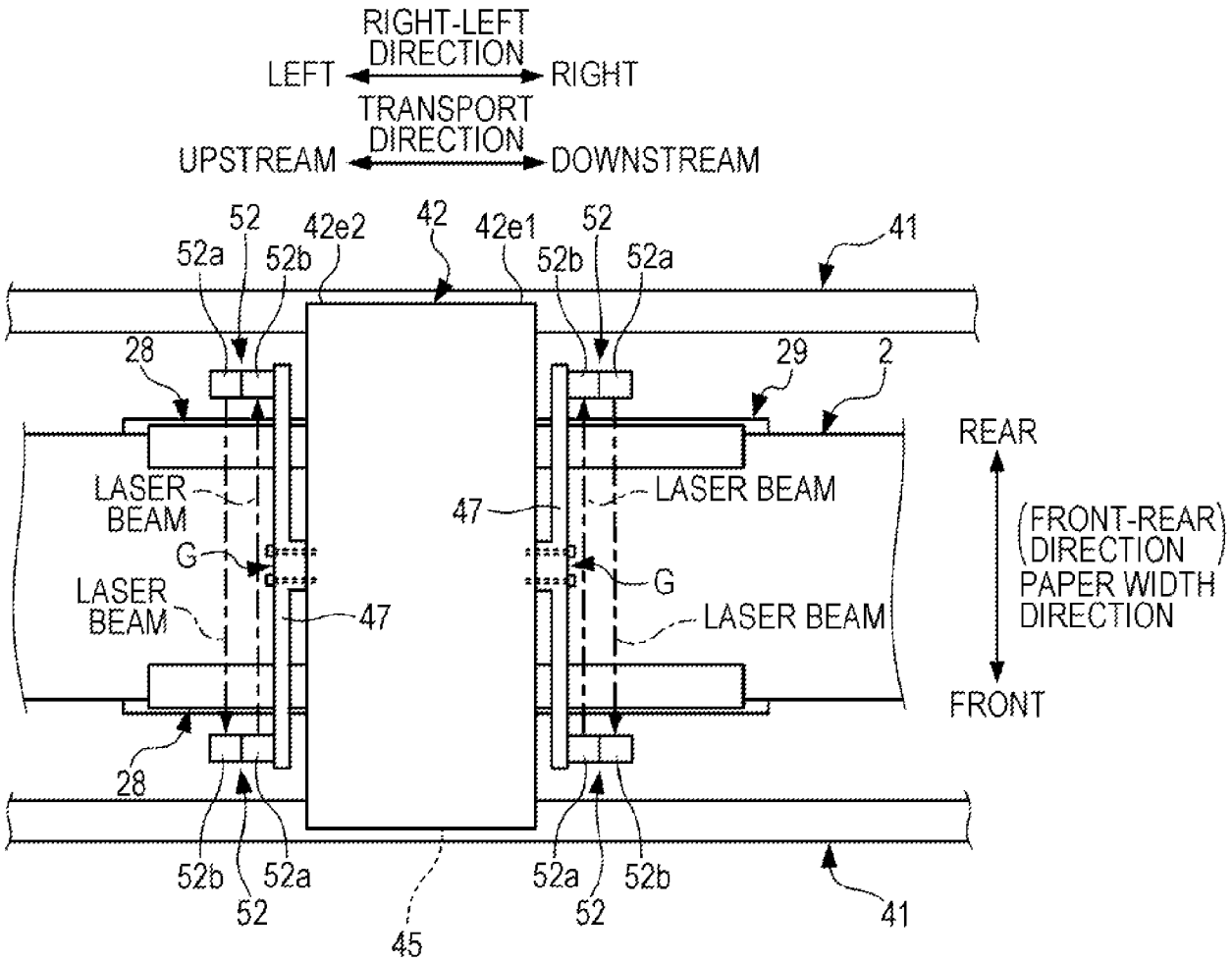
FIG. 11 is a plan view showing a case where two pairs of rolled paper sheet abnormal portion detecting sensors are disposed on both right and left end portions of a carriage.

FIG. 11 is an explanatory view that shows a preferable arrangement example of the rolled paper sheet abnormal portion detecting sensor 52 and is a plan view showing a case where two pairs of the rolled paper sheet abnormal portion detecting sensors 52 and 52 are disposed on both the right and a left end portions 42*e*1 and 42*e*2 of the carriage 42. The same reference sign is given to a configuration same as that of the embodiment described above, and the description thereof will not be repeated.

In this arrangement example, two rolled paper sheet abnormal portion detecting sensors 52 and 52 are disposed on both a right and a left end portions 42*e*1 and 42*e*2 of the carriage 42 so as to be adjacently aligned on the right and the left sides in the transport direction, as shown in FIG. 11. A pair of these rolled paper sheet abnormal portion detecting sensors 52 and 52 are set such that the light emitting directions thereof are opposite to each other.

First, regarding one end portion 42*e*1 of both of the right and the left end portions 42*e*1 and 42*e*2 of the carriage 42, an effect of the configuration in which two rolled paper sheet abnormal portion detecting sensors 52 and 52 are aligned such that the light emitting directions thereof are opposite to each other will be described. In this configuration, it is possible to effectively detect an abnormal portion even when the abnormal portion is partially generated at an arbitrary position in the paper width direction. Specifically, in a case where the foreign matter adhered to a paper sheet results in an abnormal portion or the peeling portion formed as shown in FIG. 9B results in an abnormal portion, the abnormal portion may be formed at a position close to the rear side or the front side of the paper sheet in the paper width direction (in the FIG. 9, the peeling portion is formed at a position close to the front side in the paper width direction). However, it is possible to effectively detect the abnormal portion in either case. Hereinafter, it will be described how the abnormal portion is effectively detected in either case.

Regarding the rolled paper sheet abnormal portion detecting sensor 52, there is a possibility that the detection accuracy at either one of a position close to the light emitting portion 52*a* or a position to the light receiving portion 52*b* in the paper width direction is higher (or lower) than that at the other one. It can be conceived that the reason is as follows. The platen 29 is heated to about 45° C. to dry ink landed on the rolled paper sheet 2, as described above. Thus, there is air temperature distribution in an area over the platen 29 and the rolled paper sheet 2. The temperature of the area surrounding the platen 29 is as high as 45° C., for example, and the temperature is lowered to about 25° C. going upward from the platen 29. Therefore, a refractive index of light is changed in the area due to the air temperature distribution. As a result, the laser beam emitted from the light emitting portion 52*a* is refracted upward. In this case, if an abnormal portion is present at the position close to the light receiving portion 52*b* in the paper width direction, the abnormal portion cannot adequately block the laser beam. As a result, there is a possibility that the rolled paper sheet abnormal portion detecting sensor 52 may not detect the abnormal portion because an amount of light received is reduced a little.

For this reason, in the example shown in FIG. 11, the pair of rolled paper sheet abnormal portion detecting sensors 52 and 52 is provided to prevent the detection failure. Furthermore, the rolled paper sheet abnormal portion detecting sensors 52 and 52 are arranged so that the light emitting directions thereof are opposite to each other. Therefore, the area which is close to the light receiving portion 52*b* of one rolled paper sheet abnormal portion detecting sensor 52 and where the detection accuracy of the rolled paper sheet abnormal portion detecting sensor 52 is decreased can be covered by the area which is close to the light emitting portion 52*a* of the other rolled paper sheet abnormal portion detecting sensor 52 and where the detection accuracy of the rolled paper sheet abnormal portion detecting sensor 52 is increased. Similarly, the area which is close to the light receiving portion 52*b* of the other rolled paper sheet abnormal portion detecting sensor 52 and where the detection accuracy of the rolled paper sheet abnormal portion detecting sensor 52 is decreased can be covered by the area which is close to the light emitting portion 52*a* of one rolled paper sheet abnormal portion detecting sensor 52 and where the detection accuracy of the rolled paper sheet abnormal portion detecting sensor 52 is increased.

Specifically, in one rolled paper sheet abnormal portion detecting sensor 52, the light emitting portion 52*a* thereof is installed on the front side in the paper width direction and the light receiving portion 52*b* thereof is installed on the rear side in the same direction. Furthermore, in the other rolled paper sheet abnormal portion detecting sensor 52, the light emitting portion 52*a* thereof is installed on the rear side in the paper width direction and the light receiving portion 52*b* thereof is installed on the front side in the same direction. Therefore, if the configuration in which the front range in the paper width direction is detected by the preceding rolled paper sheet abnormal portion detecting sensor 52 and the rear range in the paper width direction is detected by the following rolled paper sheet abnormal portion detecting sensor 52 is adopted, it is possible to reliably detect an abnormal portion at an arbitrary position in the paper width direction, without being influenced by the refraction of the laser beam described above. Incidentally, to ensure this operation, the controller 60 adopts control flow in which, if at least one electrical signal from two rolled paper sheet abnormal portion detecting sensors 52 and 52 is below a predetermined threshold value, it is determined that "an abnormal portion is present".

It is preferable that such a pair of rolled paper sheet abnormal portion detecting sensors 52 and 52 (see FIG. 11) or a rolled paper sheet abnormal portion detecting sensor 52 (see FIG. 6) is provided not only on one end portion of the carriage 42 in the right-left direction (the transport direction) but on both end portions thereof. In the example shown in FIG. 11, a pair of rolled paper sheet abnormal portion detecting sensors 52 and 52 are respectively provided on both end portions 42*e*1 and 42*e*2 of the carriage 42.

According to this configuration, even in a case where an abnormal portion on the rolled paper sheet 2 gradually grows and rises toward the head 31 in a printing state, it is easy to detect the abnormal portion before the abnormal portion comes into contact with head 31.

Figure 12:
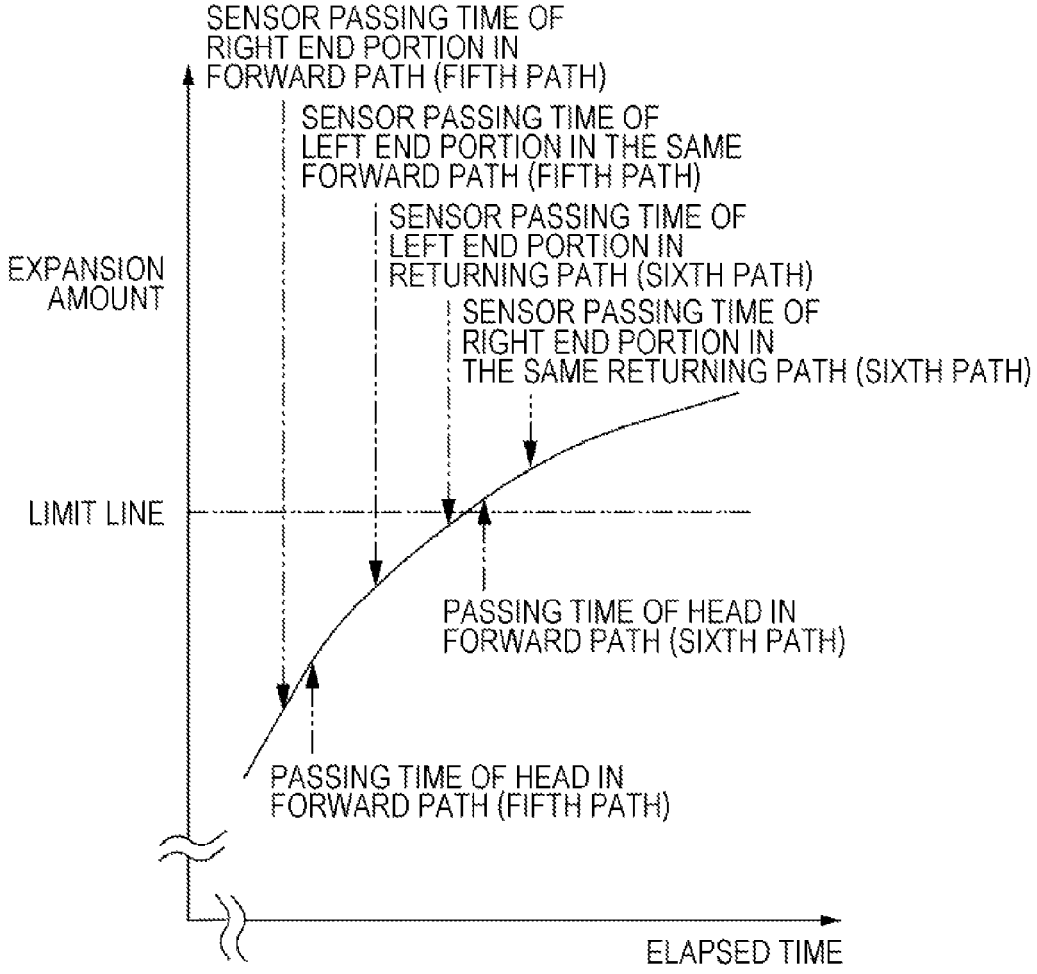
FIG. 12 is a view that shows temporal variation of an expansion amount of an abnormal portion on a rolled paper sheet.

As an example of the growing abnormal portion, there is a case where a printing paper sheet partially expands due to a fluid which is contained in ink landed, during the printing, on the rolled paper sheet 2. FIG. 12 is a view showing a graph that shows temporal variation of an expansion amount of the abnormal portion. In the graph, the vertical axis represents the expansion amount and the horizontal axis represents elapsed time from a start time of a printing operation. Furthermore, a limit line shown in the graph represents the boundary value of the expansion amount where an abnormal portion interferes with the head 31.

In a case where the rolled paper sheet abnormal portion detecting sensor 52 is provided only on the right end portion 42*e*1 of the carriage 42, as described above (see FIG. 6), when the forward path (the fifth path, for example) of the carriage 42 is carried out as described above, there is no chance of detecting an abnormal portion before the subsequent returning path (the sixth path) thereof is carried out. Furthermore, in the returning path (the sixth path), the head 31 passes through an abnormal portion, and then the rolled paper sheet abnormal portion detecting sensor 52 passes through the abnormal portion. Thus, in some cases, an abnormal portion in which the expansion amount exceeds a limit value may interfere with the head 31 during the returning path (the sixth path), as shown in FIG. 12.

On the other hand, if the rolled paper sheet abnormal portion detecting sensors 52 and 52 are respectively provided on both end portions 42*e*1 and 42*e*2 of the carriage 42, as the example shown in FIG. 11, even when an abnormal portion is not detected by the rolled paper sheet abnormal portion detecting sensor 52 on the right end portion 42*e*1 of the carriage 42 during the forward path (the fifth path, for example), the rolled paper sheet abnormal portion detecting sensor 52 on the left end portion 42*e*2 passes through the abnormal portion again before the head 31 passes through the abnormal portion. In other words, the head 31 passes through the abnormal portion during the forward path (the fifth path) described above, and immediately thereafter, the rolled paper sheet abnormal portion detecting sensor 52 on the left end portion 42*e*2 passes through the abnormal portion during the same forward path (the fifth path). In addition, during the subsequent returning path (the sixth path), the rolled paper sheet abnormal portion detecting sensor 52 on the same left end portion 42*e*2 passes through the abnormal portion before the head 31 passes through the abnormal portion. Therefore, the rolled paper sheet abnormal portion detecting sensor 52 on the left end portion 42*e*2 has twice the chance of detection, and thus the expansion amount which varies with the elapsed time can be monitored more successively and accurately. As a result, it is possible to more certainly prevent the growing abnormal portion from interfering with the head 31. In addition, although the above description focuses on a case where the forward path precedes the returning path, it is needless to say that the same operation can be carried out in a case where the returning path precedes the forward path.

Hereinbefore, the embodiments of the invention that is proposed by the inventor are described in detail. However, the invention is not intended to be limited to the embodiments described above, and it is possible to make various modifications as long as they do not depart from the spirit and scope thereof.

The fluid ejecting apparatus is mainly described in the embodiments described above, but description of a fluid ejecting method or the like is also included, for example. Furthermore, the embodiments described above are intended to facilitate the understanding of the invention, and are not intended to be construed as limiting the invention. It is needless to say that the invention can be modified or improved, as long as it does not depart from the spirit and scope thereof, and includes equivalents thereof. Particularly, the invention also includes embodiments described below.

In the embodiments described above, a fluid ejecting apparatus is embodied in a ink jet type printer. However, a fluid ejecting apparatus that ejects or discharges a fluid aside from ink may also be available, and furthermore, various types of fluid ejecting apparatuses that are equipped with a fluid ejecting head or the like ejecting a small amount of a liquid droplets can be adopted. In addition, a liquid droplet means the state of the fluid which is ejected from the fluid ejecting apparatus, and includes granule forms, teardrop forms, and forms that pull trails in a string-like form therebehind. In addition, the fluid referred to here can be any material capable of being ejected or discharged by the fluid ejecting apparatus. For example, any matter can be used as long as the matter is in its fluid phase, including fluids having high or low viscosity, sol, gel water, other inorganic solvents, organic solvents, fluid solutions, fluid resins, and fluid states such as fluid metals (metallic melts). Furthermore, in addition to fluids as a single state of matter, fluids in which particles of a functional material composed of a solid matter such as pigments, metal particles, or the like are dissolved, dispersed, or mixed in a fluid carrier are included as well. Ink, a fluid crystal, or the like is exemplified as a representative example of a fluid in the embodiments described above. In this case, the ink includes a general water-based ink and oil-based ink, aside from various fluid compositions of a gel ink, a hot melt ink, or the like.

Furthermore, in the embodiments described above, the light emitting portion 52*a* and the light receiving portion 52*b* of the rolled paper sheet abnormal portion detecting sensor 52 are mounted on a single sensor mounting member 47 and the sensor mounting member 47 is fixed to the carriage base 45 at the fixing position G. However, without being limited thereto, the light emitting portion 52*a* and the light receiving portion 52*b* may be fixed to the carriage base 45 via sensor mounting members that are separately provided. In this case, by setting a position which is close to the center of the area between the pair of carriage guide rails 41 as a fixing position of respective sensor mounting members to the carriage base 45, it is possible to suppress the influence caused by bending or distortion of the carriage guide rail 41, by the same effect as that in the embodiment described above. Therefore, it is possible to ensure the detection accuracy of the rolled paper sheet abnormal portion detecting sensor 52 when detecting an abnormal portion on a recording medium (rolled paper sheet 2).

In addition, an example where the direction of the optical axis which links the light emitting portion 52*a* and the light receiving portion 52*b* of the rolled paper sheet abnormal portion detecting sensor 52 is set to be parallel to the front-rear direction, namely the paper width direction of the rolled paper sheet 2, is explained in the embodiments described above.

However, without being limited thereto, the direction of the optical axis which links the light emitting portion 52*a* and the light receiving portion 52*b* of the rolled paper sheet abnormal portion detecting sensor 52 may be inclined, at a predetermined angle, in the front-rear direction, namely the paper width direction of the rolled paper sheet 2. In this case, if, for example, a peeling portion is formed linearly so as to be parallel to the front-rear direction, namely the paper width direction of the rolled paper sheet 2, as a peeling portion extending in a direction shown in FIG. 9B, (that is, the peeling portion is linearly formed so as to cross both one end portion and the other end portion in the front-rear direction, namely the paper width direction), it is possible to prevent detection failure where the laser beam emitted from the light emitting portion 52*a* passes through a tunnel-shaped gap of the peeling portion and arrives at the light receiving portion 52*b*, and therefore, the peeling portion is not detected. Thus, it is possible to maintain high detection accuracy when detecting an abnormal portion on the rolled paper sheet 2, such as a peeling portion.

Furthermore, in the embodiments described above, the printer (liquid droplet ejecting device) forms an image on a recording medium on the platen by causing the head carriage including the ink jet head to scan the recording medium that is positioned on the platen, and causing the ink jet head to eject ink during the scanning. However, the configuration of the printer is not limited thereto, and the operation and effect of the invention can be achieved as long as the printer is configured so that the ink jet head moves relative to the recording medium and ink is ejected from the ink jet head during the relative movement. The printer may be a so-called line head type ink jet printer in which an ink jet head is fixed inside a printing device and only a recording medium moves in the transport direction so as to receive ink which is ejected from the ink jet head.

REFERENCE SIGNS LIST

1: printer as fluid ejecting apparatus, 2: rolled paper sheet as recording medium, 10: feed unit, 20: transport unit, 29: platen as support portion, 30: head unit, 31: head, 40: carriage unit, 41: carriage guide rail, 42: carriage, 45: carriage base, 47: sensor mounting member, 50: detector group, 52: abnormal portion detecting sensor, 52*a*: light emitting portion, 52*b*: light receiving portion, 52*c*: converter, 60: controller, 61: interface portion, 62: CPU, 63: memory, 64: unit control circuit, 80: blower unit, 81: fan, 90: winding unit, 110: host computer The entire disclosure of Japanese Patent Application No. 2012-188407, filed on Aug. 29, 2012, is expressly incorporated by reference herein.

The invention claimed is:

1. A fluid ejecting apparatus comprising:

a transport portion that transports a recording medium;

a support portion that supports the recording medium;

a head that ejects a fluid onto the recording medium supported by the support portion;

a carriage that holds the head and can move in a transport direction of the recording medium;

a pair of carriage guide rails that supports the carriage such that the carriage can move in the transport direction of the recording medium; and an abnormal portion detecting sensor that has a light emitting portion which is disposed on one end side in a width direction of the recording medium, which is perpendicular to the transport direction of the recording medium, and a light receiving portion which is disposed on the other end side in the width direction such that a light beam emitted from the light emitting portion is received on the other end side, and detects an abnormal portion on the recording medium, wherein the light emitting portion and the light receiving portion are mounted on the carriage via a sensor mounting member, and wherein the sensor mounting member is fixed to the carriage at a position close to the center of the carriage in the width direction, within an area specified by the pair of carriage guide rails.

2. The fluid ejecting apparatus according to claim 1, wherein the light emitting portion and the light receiving portion are aligned and mounted on the single sensor mounting member, and wherein the sensor mounting member is fixed to the carriage at an intermediate position in an area between the light receiving portion and the light emitting portion.

3. The fluid ejecting apparatus according to claim 1, wherein a pair of the abnormal portion detecting sensors are provided so as to be aligned in the transport direction of the recording medium, and wherein the pair of abnormal portion detecting sensors are arranged so that the light emitting directions thereof are opposite to each other.

* * * * *